US005406917A

United States Patent [19]

Rao et al.

[11] Patent Number: 5,406,917

[45] Date of Patent: Apr. 18, 1995

[54] OIL-STARVED VALVE ASSEMBLY

[75] Inventors: V. Durga N. Rao, Bloomfield Township, Oakland County; Gary M. Crosbie, Dearborn, both of Mich.

[73] Assignee: Ford Motor Company, Dearborn, Mich.

[21] Appl. No.: 168,097

[22] Filed: Dec. 15, 1993

Related U.S. Application Data

[62] Division of Ser. No. 869,291, Apr. 13, 1992, Pat. No. 5,295,461.

[51] Int. Cl.[6] ..... F01L 3/04

[52] U.S. Cl. ..... 123/188.9; 123/188.3; 29/888.4; 29/888.41; 29/888.4

[58] Field of Search ..... 123/188.3, 118.9; 29/888.4, 888.41, 888.14

[56] References Cited

U.S. PATENT DOCUMENTS

| | | | |
|---|---|---|---|
| 2,064,155 | 12/1936 | Fahrenwald | 22/203 |
| 2,240,202 | 4/1941 | Anselmi | 75/159 |
| 2,664,874 | 1/1954 | Graham | 123/188.3 |
| 2,745,777 | 5/1956 | Clarke, Jr. | 148/31 |
| 3,930,071 | 12/1975 | Rao et al. | 427/203 |
| 4,073,474 | 2/1978 | Hashimoto et al. | 251/368 |
| 4,269,391 | 5/1981 | Saito et al. | 251/315 |
| 4,359,022 | 11/1982 | Nakamura et al. | 123/188.3 |
| 4,465,040 | 8/1984 | Pelizzoni | 123/188.9 |
| 4,484,547 | 11/1984 | Nickerson | 123/188.9 |
| 4,546,737 | 10/1985 | Kazuoka et al. | 123/188.5 |
| 4,554,897 | 11/1985 | Yamada et al. | 123/188.3 |
| 4,554,898 | 11/1985 | Yamada et al. | 123/188.3 |
| 4,723,518 | 2/1988 | Kawasaki et al. | 123/188.5 |
| 4,728,078 | 3/1988 | Oda et al. | 351/360 |
| 4,763,876 | 8/1988 | Oda et al. | 251/359 |
| 4,844,024 | 7/1989 | Fujiki et al. | 123/188.5 |
| 4,851,375 | 7/1989 | Newkirk et al. | 501/88 |
| 4,867,116 | 9/1989 | de Freitas Couto Rosa | 123/188.3 |
| 4,872,432 | 10/1989 | Rao et al. | 123/193.4 |
| 4,881,500 | 11/1989 | Kojima et al. | 123/188.3 |
| 5,076,866 | 12/1991 | Koike et al. | 148/437 |
| 5,295,461 | 3/1994 | Rao et al. | 123/188.9 |

FOREIGN PATENT DOCUMENTS

| | | |
|---|---|---|
| 0224345 | 6/1987 | European Pat. Off. . |
| 2155765 | 6/1972 | Germany . |
| 5578119 | 6/1980 | Japan . |
| 56-115804 | 9/1981 | Japan . |

OTHER PUBLICATIONS

"Friction and Wear Properties of a Ceramic Matrix Composite Produced by Directed Metal Oxidation", R. K. Dwivedi, Ceram. Eng. Sci. Proc.12[9-10], pp. 2203-2221, Oct. 1991.

*Primary Examiner*—Willis R. Wolfe
*Assistant Examiner*—Erick Solis
*Attorney, Agent, or Firm*—Roger L. May; Joseph W. Malleck

[57] ABSTRACT

A valve assembly (10) for use in an engine (12), comprising a valve stem guide (14) and a valve seat insert (40) mounted within the engine (12), the valve stem guide (14) and the valve seat insert (40) being provided with a solid film lubricant (30) impregnated therewithin. A valve (20) is reciprocatingly received within the internal bore (16) of the tubular valve stem guide (14). The valve (20) includes an axially extending valve stem (22) which is received by the solid film lubricant (30) within the valve stem guide (14), thereby reducing friction therebetween. The valve stem (22) and the valve stem guide (14) are formed so as to cooperate with associated components within narrowly defined dimensional tolerances in a manner which has the characteristics of reduced friction and lessened passage of oil to the exhaust system of the engine (12). The valve guide assembly (10) thus has the characteristic of being operable in an oil-starved state. The invention comprises the valve assembly (10) itself, the method of preparing it, and the composition of matter of which it is made.

3 Claims, 3 Drawing Sheets

OIL-STARVED VALVE ASSEMBLY

This is a divisional of application Ser. No. 07/869,291 filed on Apr. 13, 1992, now U.S. Pat. No. 5,295,461.

BACKGROUND OF THE INVENTION

1. Field of the Invention

This invention relates generally to valve assemblies for deployment in an internal combustion engine. More specifically, the invention relates to a valve assembly which is starved of oil and which is self-lubricating in order to reduce catalyst poisoning by engine oil constituents.

2. Related Art Statement

Emission reductions in automobile exhaust systems will continue to be required in most passenger and commercial vehicles for the foreseeable future. Contaminants from engine lubricating oil are recognized as a major contributory factor to some types of catalyst poisoning in a catalytic converter.

Engine lubricating oil may pass into the catalytic converter through the engine valve assembly. The conventional valve assembly includes a valve guide which is housed within a cylinder head of an internal combustion engine. Received within the valve guide is a valve having a valve stem and a valve head connected thereto. The valve stem is reciprocatingly engaged within the valve guide. Conventionally, a valve stem seal is disposed around a portion of the valve stem which protrudes beyond the valve guide.

In most engines used today, oil tends to reach the exhaust stream from flow between certain components of the valve assembly—such as the valve guide and the valve stem, or between the valve head and a valve seat. In practice, some flow is generally considered to be necessary so that a relatively friction-free interface is provided between the valve stem and guide during reciprocal movement—especially at high temperatures.

Simply stated, if oil enters the exhaust system, it will burn. However, if some oil does not penetrate into the valve and valve guide interface, the valve guide will wear. By controlling leakage through a valve stem seal, a compromise can be reached between lubricity and catalyst poisoning.

It is known that a valve seat defined within the cylinder head, which cooperates with the valve head, is exposed to an environment having a significantly higher temperature than that to which the valve stem is exposed. To accommodate differential heating, substantial clearance between conventional materials is often needed to avoid seizure. But as the clearance is increased, engine oil may penetrate into the exhaust system between the valve seat and the valve head.

As a practical matter, if seizures can be avoided, smaller dimensional tolerances in today's valve assemblies can be achieved by using stiffer materials having superior thermal conductivity. Such a design approach offers the attribute of better alignment of the valve stem within the valve guide and offers lower maximum bending stresses. When tolerances are reduced, the amount of oil transferred into the exhaust system tends to be diminished.

To satisfy such design criteria, a need has arisen to provide materials which exhibit a low coefficient of thermal expansion and a high thermal conductivity, together with good wear resistance and stiffness. If the valve guide and associated valve materials are selected so that there is a closer match of thermal expansion characteristics, smaller clearances can be designed into the valve assembly, despite the need for member components to operate alternately in hot and cold conditions.

However, in most materials available today, it is relatively unusual to find an acceptable combination of high stiffness and high thermal conductivity. If this relatively unusual combination of characteristics is found, such materials would allow tighter tolerances, less oil loss, better alignment, and lower maximum stresses.

Such opportunities may be afforded by dry-lubricated materials, which are the subject of this invention. When engineered into components such as valve guides, such material will permit close tolerances, so that a dry-lubricated valve guide will result in a reduced level of catalyst poisoning by engine oil constituents.

Of interest is commonly owned U.S. Pat. No. 4,872,432 which issued on Oct. 10, 1989 to Rao, et al. Dr. Rao is a co-inventor of the present application. That reference discloses a gas phase lubrication system which operates effectively within an oilless engine. The gas phase lubrication system includes an annular body of graphite carrying a high temperature solid lubricant within the piston or the cylinder. Also described is an elastomer which is retentive of elasticity at the maximum operating temperature to be experienced, the elastomer being interposed to close the piston-cylinder cap under substantially all operating conditions of the engine. Grooves entrap combustion gases, which function as a bearing over which the piston rides during reciprocation. The disclosure of U.S. Pat. No. 4,872,432 is herein incorporated by reference. In that disclosure, a cylinder wall surface is thoroughly cleansed to remove any oxidation before grit blasting to increase porosity and thereby the reception of a coating. Unlike that disclosure, the approach of the present invention calls for porosity (and adhesion) to be achieved by a different mechanism.

U.S. Pat. No. 4,851,375 issued on Jul. 25, 1989 to Newkirk, et al, and is assigned to Lanxide Technology Company, LP. That reference discloses a method for producing a self supporting ceramic composite structure with a ceramic matrix. The matrix is prepared by oxidation of a parent metal to form a polycrystalline material which consists essentially of the oxidation reaction product. The disclosure of U.S. Pat. No. 4,851,375 is also incorporated here by reference. However, there is no suggestion in that reference of a provision which would enable the metallic phase to be removed and a dry lubricant inserted in its place so that a zero clearance between the mating components can be attained and maintained.

Also of interest is Japanese Patent No. 151708 which was published on Dec. 6, 1980, and is assigned to Nissan Motor KK. That reference discloses a valve guide for an internal combustion engine. The valve guide is formed from a ceramic material consisting of silicon carbide or silicon nitride. That reference suggests that the valve guide exhibits small abrasion losses and requires almost no lubricating oil because of its ceramic properties.

Accordingly, it is an object of the present invention to provide an oil-starved valve assembly for an internal combustion engine, the valve assembly having reduced friction, yet offering considerably reduced leakage of engine oil into the exhaust system.

It is also an object of this invention to control dimensional clearances between the valve and the valve guide or between the valve head and valve seat insert of an internal combustion engine. Such clearances may vary due to thermal variations of the materials used therein and mechanical variations which are attributable to loads imposed on the member components of the valve assembly.

It is a further object of the invention to provide a valve assembly including a valve stem guide which has an internal bore with a solid film lubricant impregnated therewithin so that friction therebetween is reduced and the passage of oil to the exhaust system of the engine is minimized.

It is a still further object of the present invention to provide a solid film lubricant impregnated within a valve seat insert disposed within the engine, thereby further limiting the passage of oil to the exhaust system thereof.

Additionally, it is another object of the invention to provide a solid film lubricant which comprises a composite of a solid lubricant impregnated into an oxide-metal material.

Furthermore, it is an object of the invention to provide a composition of matter including an oxide-metal material and a dry lubricant, wherein the oxide-metal material forms a matrix having anchoring sites for retaining the dry lubricant therewithin, the resulting composition having the characteristic of lubricity at elevated temperatures.

Also, it is an object of the present invention to provide a process for preparing a composition of matter, preferably a valve assembly, the assembly including a valve stem guide with an intermixed phase composite of a metal, a metal oxide, and silicon carbide, the process calling for a fluid lubricant in the form of a resin suspension of boron nitride, molybdenum disulfide, graphite, and mixtures thereof.

SUMMARY OF THE INVENTION

The present invention is an oil-starved valve assembly which is used in an internal combustion engine. The assembly comprises a valve stem guide mounted within the engine. The valve stem guide is provided with an internal bore having a solid film lubricant impregnated therewithin. The solid film lubricant comprises intermixed phases of a dry lubricant which are impregnated into pores, or anchoring sites, in the valve guide which remain after a metal phase is removed by etching.

Within the valve stem guide, a valve is reciprocatingly received. The valve includes an axially extending valve stem which cooperates with the solid film lubricant within the internal bore, thereby reducing friction and oil leakage therebetween.

Conventionally, a valve seat insert is provided within a cylinder head of the engine which may cooperate with the valve head to provide a sealing relationship therebetween. In an alternate embodiment of the invention, the valve seat insert is provided with a solid film lubricant impregnated therewithin.

The invention also comprises a process for preparing the oil-starved valve assembly. The process includes the step of providing a resin suspension of a lubricant selected from the group consisting essentially of boron nitride, molybdenum disulfide, graphite, and mixtures thereof. A metal phase is removed from an intermixed phase composite of the metal, a metal oxide, and silicon carbide, of which the valve component is made. This step creates pores or anchoring sites for retaining the lubricant. The valve component is exposed to the resin suspension of lubricants so that they may infiltrate or permeate the anchoring sites formed within the intermixed phase composite.

The lubricant-impregnated valve component is then exposed to a vacuum environment to expel air from the anchoring sites. After ambient pressure is restored, the lubricant becomes driven or impregnated into the anchoring sites. The valve component and lubricant are then desiccated to create an intermixed composite of solid dry lubricant which is impregnated into the valve component.

By a similar process, the solid dry lubricant may be impregnated into the valve seat insert, thus providing an acceptable combination of lubricity under conditions of minimal, or zero clearance.

The present invention will become more fully understood from the detailed description given below and the accompanying drawings.

BEST MODES FOR CARRYING OUT THE INVENTION

Figure 1:
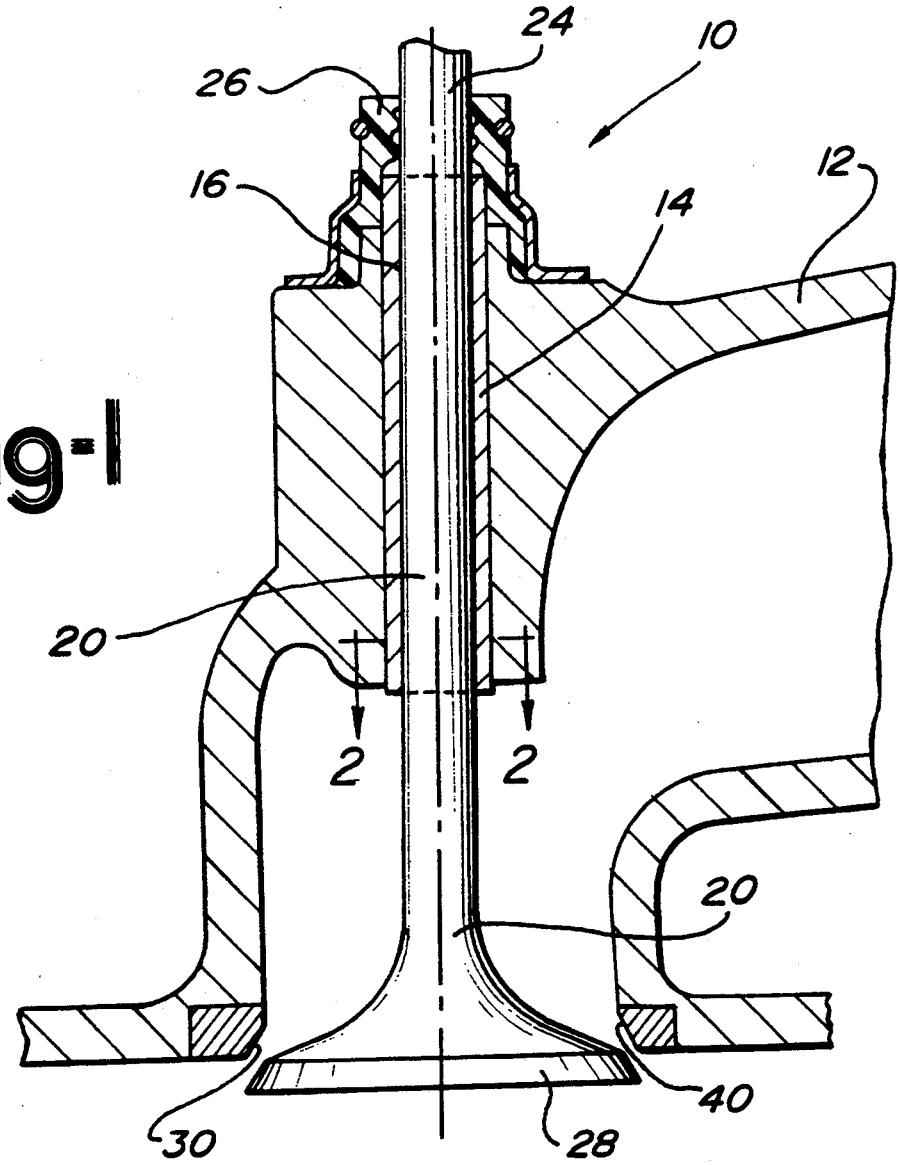
FIG. 1 is a partial sectional view of an oil-starved valve assembly for use in an internal combustion engine having a cylinder head.

Referring first to FIG. 1 of the drawings, there is depicted a valve assembly 10 which is used in an engine, part of the cylinder head of which is designated by the reference number 12. The valve assembly 10 includes a generally tubular valve stem guide 14 which is mounted within the cylinder head of the engine 12. The tubular valve stem guide 14 is provided with an internal bore 16 having a solid film lubricant 18 impregnated therewithin. Details of the microstructure and morphology of the solid lubricant-impregnated valve stem guide appear later in the discussion of FIG. 3.

Figure 2:
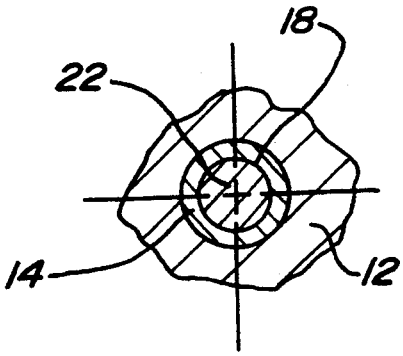
FIG. 2 is a cross-sectional view of a part of the valve assembly of FIG. 1 taken along the line 2—2 thereof.

Continuing with primary reference to FIGS. 1 and 2, it will be readily appreciated that the valve assembly 10 includes a valve 20 which is reciprocatingly received within the internal bore 16 of the tubular valve stem guide 14. The valve 20 includes an axially extending valve stem 22 which is received by the solid film lubricant 18 deployed within the valve stem guide 14. As a result, friction between the valve stem guide 14 and the valve 20 is reduced. Additionally, the valve stem 22 and the valve stem guide 14 are formed so as to cooperate within narrowly defined dimensional tolerances in a manner which has the characteristic of reduced friction, while limiting the passage of oil to the exhaust system of the engine 12.

Those familiar with the art will readily appreciate that the valve stem 22 has a distal end 24 which extends beyond the cylinder head of the engine 12. Disposed between the distal end of the valve stem 22 and the engine 12 is a valve stem seal 26.

To enable the valve assembly 10 to operate even more effectively in an oil-starved state, another film of solid lubricant 30 may be impregnated within a valve seat insert 40 (FIG. 1). The solid film lubricant 30 cooperates with a valve head 28 to provide a sealing relationship therebetween. As a result, the passage of oil into the exhaust system is further limited when the valve is seated, as is the fouling of an associated catalytic converter by engine oil constituents, and the associated emission of hydrocarbons from the engine 12.

Figure 3:
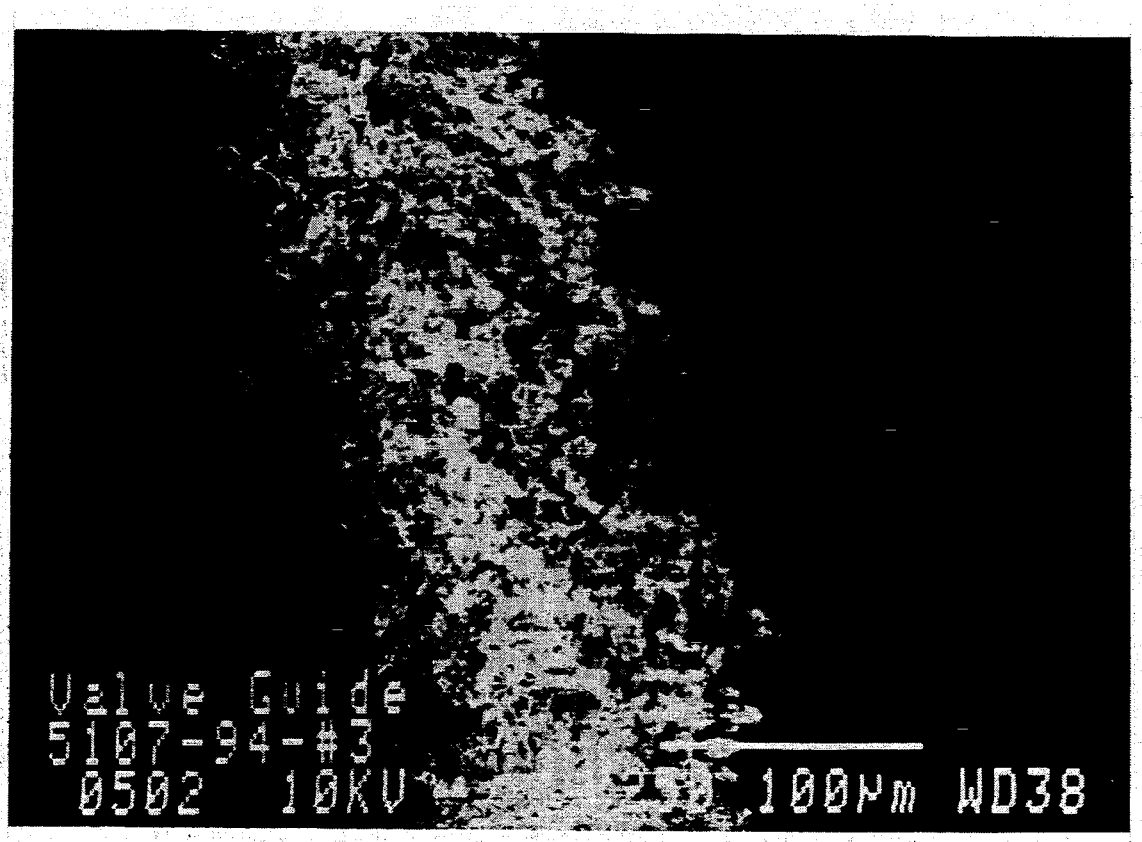
FIG. 3 is a photo taken by scanning electron microscopy (SEM) along the plane of FIG. 2, which illustrates the surface topography of an inter-mixed composite of solid dry lubricant impregnated into the internal bore of the valve guide.

To appreciate the microstructure and morphology of the solid film lubricant, reference will now be made to the SEM photograph of FIG. 3. Examination by SEM shows that the films 18, 30 of solid lubricant comprise a composite of a solid lubricant which is impregnated into an oxide-metal material 32 of which the valve stem guide 14 or the valve seat insert 40 are formed.

The composition of matter disclosed by the present invention thus comprises a 3-dimensional network of an oxide-metal material 32 and a solid lubricant 42. Prepared in a manner to be described later, the oxide-metal material 32 forms a matrix having anchoring sites 38 for retaining the solid lubricant at least partially within the oxide-metal material 32. Consequently, the solid lubricant 42 and the oxide-metal material 32 are intimately combined as a heterogeneous structure of intermixed phases. This composite has the characteristic of lubricity at elevated temperatures associated with operation of an engine.

Figure 4:
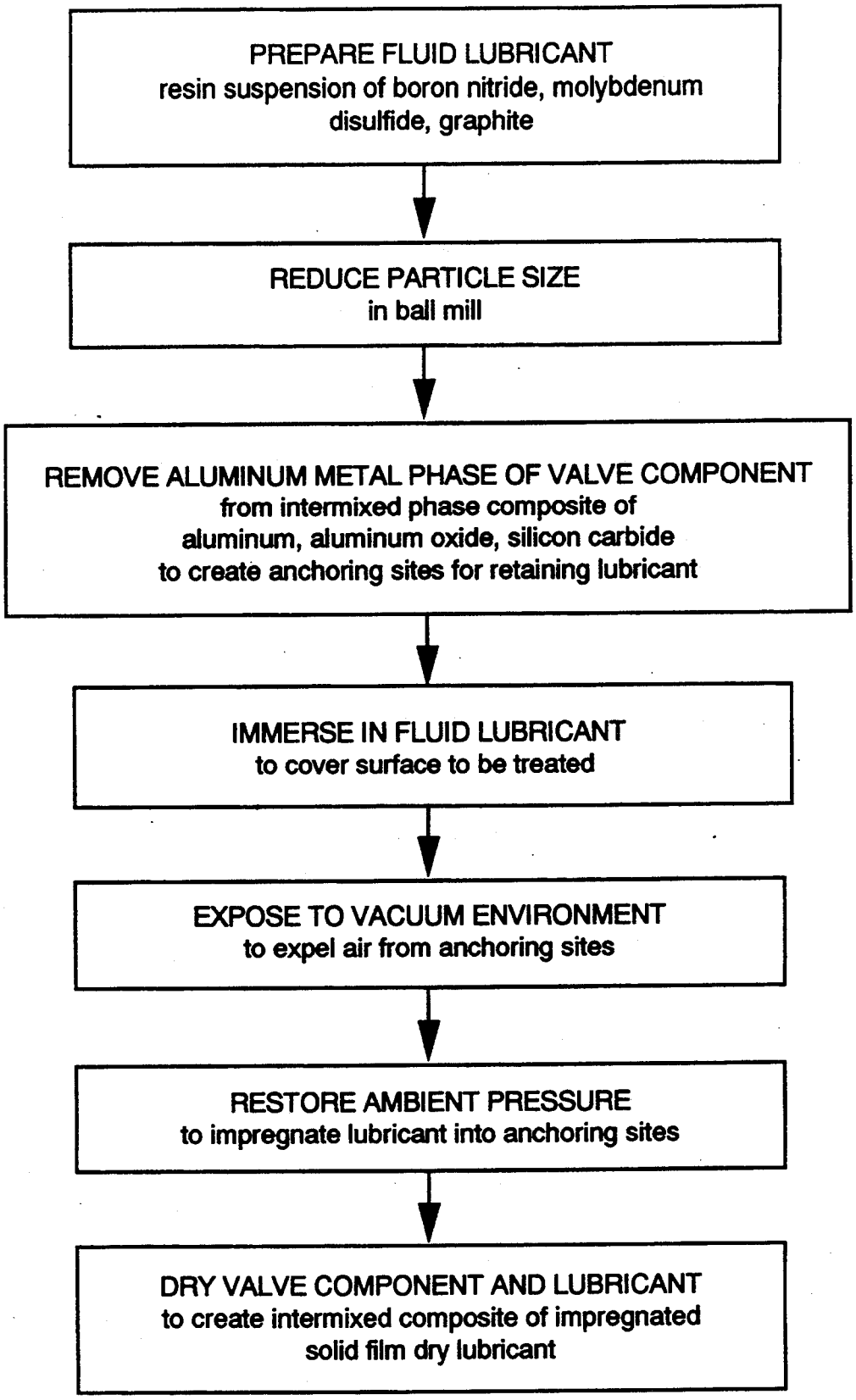
FIG. 4 is a process flow diagram depicting the main steps involved in preparing the valve assembly.

As depicted in FIG. 4, the process for preparing the oil-starved valve assembly of the present invention includes the preparation of a suitable lubricant in fluid form. Preferably, the fluid lubricant comprises a resin suspension of boron nitride, and/or molybdenum disulfide, and graphite. Boron nitride is selected in part for its graphite-like, hexagonal plate structure, which provides low mechanical strength, thermal stability, and compatibility with polymers at high temperatures. Such characteristics make it an ideal candidate for a solid film lubricant. Molybdenum disulfide is selected for its lubricity and stability in an oxidizing atmosphere at temperatures greater than about 580°–600° F., together with its high load-bearing capacity. Graphite is selected for its relative softness, lubricity, and resistance to oxidation and thermal shock.

If desired, particle sizes can be reduced by a ball mill in a conventional manner. Exposure time in the ball mill may last up to four days, or longer if desired. As a result of exposure to the ball mill, the largest particle sizes do not exceed 4 microns. This particle size corresponds to the narrowest necks of anchoring sites or pores 38 which are formed by etching away the metal phase of the inter-mixed phase composite of metal oxide and silicon carbide.

Preferably, the resin suspension comprises about 40% by weight of a high temperature thermoplastic resin such as polyarylsulfone, 20% of either molybdenum disulfide or boron nitride (or both), and 40% of graphite. A resin that is thermally stable up to about 700° F. is polymer 360, known as Astrel, which is manufactured by the Minnesota Mining and Manufacturing Company. Such a resin may be dissolved in dimethylacetamide to make a syrupy paste which facilitates the blending of ingredients. These ingredients were disclosed in U.S. Pat. No. 4,872,432 (Col. 6, lines 15–22). A high temperature epoxy which exhibits suitable thermo-setting characteristics, such as Novelac or Epon, can also be selected in addition to the poly aryl sulfone family of thermoplastics, which are available from Thermoset Plastics, Inc. in Indianapolis, Ind. The latter include a polyphenylene sulfide known as Radel.

According to the present invention, a component 14 to be treated comprises an intimate phase composite of aluminum, aluminum oxide, and silicon carbide. Similar composites have been disclosed in U.S. Pat. No. 4,851,375 (see, e.g., FIG. 5E thereof). However, in that reference, a metallic constituent is present. In the composite of the present invention, the superficial metal (aluminum) phase is removed by an etching step. A suitable etchant is hydrofluoric acid (25% strength), a mixture of hydrofluoric, nitric, and hydrochloric acids, corresponding to a concentrated form of Keller's etch, a widely used metallographic etchant for aluminum.

As a result of the etching step, the anchoring sites or pores 38 are created for retaining the lubricant in its fluid state before, and its dry state after desiccation.

Next, the component 14 is exposed to the fluid lubricant so that it may infiltrate the anchoring sites 34 formed within the intermixed phase composite 32.

The lubricant-covered component 14 is then subjected to a vacuum environment to expel air from the anchoring sites 38. If desired, the component can be subjected to a vacuum environment before exposure to the solid film lubricant. Thereafter, ambient pressure is restored. This has the effect of propelling the lubricant into the anchoring sites, which then become saturated thereby. Next, the component 14 and the lubricant are dried, that is, dessicated by the evaporation of the volatile organic constituent. After drying, an intermixed composite of a solid film, dry lubricant is created which is impregnated into the component 14. Its topography is depicted in FIG. 3.

In one experiment, cylindrical intake and exhaust valve stem guides 14 were submerged into an uncured resin suspension. After a vacuum was drawn to expel any air remaining in the pores of the guides, ambient pressure was restored after two minutes. This had the effect of driving the suspension of resin and lubricant into the material of which the components are comprised.

After this infiltration step, one sample was remachined to the same dimensions as existed before submerging into the uncured resin suspension. The remachined sample exhibited a weight gain as a result of the impregnation.

Other composites were machined to a predetermined inside bore diameter to provide dimensional tolerances between the valve stem and valve guide which are more exacting than usual. A cross-sectional cut of an impregnated blank was made (FIG. 3) and subjected to scanning electron microscopy (SEM): That section includes a region having a depth of about 50 microns which has been de-nuded of the aluminum metal phase. Energy-dispersive x-ray analysis of the near inside diameter region testifies to the presence of molybdenum and sulfur. Analyses were carried out at four points identified with numerals one (1) through four (4), in the etched zone. $MoS_2$ was detected to a depth of the numerals one (1) and two (2), or approximately 60 microns. This confirms impregnation by the resin suspension of lubricants into the composite.

Further experiments involved the installation of two exhaust and two intake valve guides in an engine. Those tests confirmed that friction was low—at values of approximately half that of the conventional system. Oil leakage along the valve—valve guide interface was small—not more than a third of the conventional system. Before and after testing, the guide specimens were measured for surface roughness and diameter. Dimensional changes were minimal—not more than 2 microns. Initial tests have shown that the solid film lubricant of the present invention may reduce wear by as much as 75%.

Such experiments have shown that in comparison with conventional valve-valve guide combinations, the present invention results in (1) lower friction; (2) less wear for a given tolerance, and (3) less oil leakage into the exhaust system of the engine. As a result, there is a diminished tendency to foul catalytic converters and to emit hydrocarbons.

The experiments fail to show any evidence of debonding, micro-fracture, or grain pull-out on the wear surface. Additionally, there was no evidence of metal transfer from the valve components to the valve stem or to the valve head. Nor was there any evidence of scuffing damage.

In light of this disclosure, it will be apparent that the solid film lubricant 18,30 of the present invention includes intermixed phases of a dry lubricant which is impregnated into anchoring sites or pores which remain after etching the metal phase from an oxide-metal material. That solid film lubricant 18, 30 is intimately bonded via the anchoring sites to the unetched interior of the oxide-metal material.

Applicants do not wish to be bound by any particular chemical or mechanical theory of the relevant material systems which explains why the composition of matter and the disclosed valve components exhibit the properties which have been observed. Nevertheless, it would appear that the resin, acting as a liquid carrier of solids, acts as a polymer with a high coefficient of thermal expansion. For a given temperature rise, a globule of resin will expand within the constraints composed by the confining anchoring sites. As a result, the solid lubricant will tend to be expelled therefrom, and will serve to promote lubricity.

Preferably, the valve stem 22 will be comprised of silicon carbide or a Ti-6-Al-4V alloy. Such alloys are selected for their relatively low density and low coefficient of thermal expansion. Alternatively, a hollow copper beryllium alloy can be used as the valve stem. A suitable selection would be Cu 98.1, Be 1.9 (C17200).

The valve stem guide, like the valve stem can be formed from a copper beryllium alloy, which is especially suited to a Ti-6-Al-4V alloy valve stem. Such a combination has been found to exhibit the characteristics of high wear resistance when impregnated with a solid film lubricant of siliconized graphite. Preferably, the valve stem guide 14 is formed from a metal matrix composite of aluminum, which is especially suited for a steel valve stem. The valve stem guide may alternatively be impregnated with a solid film lubricant such as siliconized graphite.

The valve seat insert 40 can be formed from a copper beryllium alloy or a powder metal steel and impregnated with a solid film lubricant to minimize abrasion with the valve head 28.

The valve stem seal 26 may comprise a graphite-filled high temperature elastomer, such as silastic, or certain fluoro polymers, as disclosed in U.S. Pat. No. 4,872,432.

Thus, there has been disclosed an oil-starved valve assembly which is self-lubricating in order to allow reduced dimensional clearances and minimize catalyst poisoning by engine oil constituents. The invention comprises the valve assembly itself, the method of preparing it, and the composition and method of which it is made.

We claim:

1. A process for preparing a valve assembly for use in an engine, the assembly including a valve stem guide comprising an intermixed phase composite of a metal, a metal oxide, and silicon carbide, and a valve reciprocatingly received therewithin, the method including the steps of:

providing a fluid lubricant in the form of a resin suspension of a lubricant selected from the group consisting of boron nitride, molybdenum disulfide, graphite, and mixtures thereof;

removing the metal phase from the face of the composite to create anchoring sites for retaining the lubricant;

exposing the face of the composite to the fluid lubricant so that the lubricant may infiltrate the anchoring sites;

subjecting the lubricant-covered face to a vacuum environment to expel air from the anchoring sites;

restoring ambient pressure to propel the lubricant into the anchoring sites; and desiccating the composite and the lubricant to create an article of manufacture in which a solid film, dry lubricant is impregnated into the face of the composite.

2. A process for preparing a valve assembly for use in an engine, the assembly including a valve seat insert comprising an intermixed phase composite of a metal, a metal oxide and silicon carbide, and a valve head intermittently received by the valve seat, the method including the steps of:

providing a fluid lubricant in the form of a resin suspension of a lubricant selected from the group consisting of boron nitride, molybdenum disulfide, graphite, and mixtures thereof;

removing the metal phase from the valve seat insert to create anchoring sites for retaining the lubricant;

exposing the valve seat insert to the fluid lubricant so that the lubricant may infiltrate the anchoring sites formed within the valve seat insert;

subjecting the lubricant-covered valve seat insert to a vacuum environment to expel air from the anchoring sites;

restoring ambient pressure to propel the lubricant into the anchoring sites; and desiccating the valve seat insert and the lubricant to create an intermixed composite of solid film, dry lubricant which is impregnated into the valve seat insert.

3. A process for preparing a valve assembly for use in an engine, the assembly including a valve stem guide and a valve seat insert comprising an intermixed phase composite of a metal, a metal oxide, and silicon carbide, the method including the steps of:

providing a fluid lubricant in the form of a resin suspension of a lubricant selected from the group consisting essentially of boron nitride, molybdenum disulfide, graphite, and mixtures thereof;

removing the metal phase from the valve stem guide and the valve seat insert to create anchoring sites for retaining the lubricant;

impregnating the lubricant into the anchoring sites; and curing the resin so that the lubricant forms a solid dry film thereof which is disposed upon the valve stem guide and the valve seat insert.

* * * * *